US006780078B2

(12) United States Patent
Hageman et al.

(10) Patent No.: US 6,780,078 B2
(45) Date of Patent: Aug. 24, 2004

(54) TOY ASSEMBLY AND A METHOD OF USING THE SAME

(75) Inventors: Robert Hageman, Orchard Park, NY (US); Robert W. Jourdian, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 48 days.

(21) Appl. No.: 10/285,701

(22) Filed: Nov. 1, 2002

(65) Prior Publication Data

US 2004/0087242 A1 May 6, 2004

(51) Int. Cl.[7] ..... A63H 30/00
(52) U.S. Cl. ..... 446/175; 446/410; 446/467
(58) Field of Search ..... 446/175, 410, 446/454, 467

(56) References Cited

U.S. PATENT DOCUMENTS

| | | | | |
|---|---|---|---|---|
| 2,846,815 A | | 8/1958 | Smith | |
| 2,882,644 A | | 4/1959 | Bonanno et al. | |
| 4,334,221 A | | 6/1982 | Rosenhagen et al. | |
| 4,563,162 A | | 1/1986 | Ishimoto | |
| 4,914,431 A | | 4/1990 | Severson et al. | |
| 5,085,610 A | * | 2/1992 | Engel et al. | 446/175 |
| 5,251,856 A | | 10/1993 | Young et al. | |
| 5,441,223 A | | 8/1995 | Young et al. | |
| 5,749,547 A | | 5/1998 | Young et al. | |
| 5,791,253 A | | 8/1998 | Schultheis et al. | |
| 5,816,887 A | | 10/1998 | Rudell et al. | |
| 5,885,159 A | | 3/1999 | DeAngelis | |
| 5,888,135 A | | 3/1999 | Barton, Jr. et al. | |
| 5,944,607 A | | 8/1999 | Crane | |
| 5,944,609 A | | 8/1999 | Crane et al. | |
| 6,238,265 B1 | | 5/2001 | Crane et al. | |
| 6,247,994 B1 | | 6/2001 | DeAngelis et al. | |
| 6,428,383 B1 | | 8/2002 | Allmon et al. | |
| 6,450,856 B1 | | 9/2002 | Aldred et al. | |
| 6,457,681 B1 | | 10/2002 | Wolf et al. | |
| 6,475,059 B1 | | 11/2002 | Lee | |
| 6,491,566 B2 | | 12/2002 | Peters et al. | |
| 6,565,410 B1 | * | 5/2003 | Allen | 446/454 |
| 6,585,618 B2 | | 7/2003 | Lu | |
| 6,616,505 B1 | * | 9/2003 | Reagan et al. | 446/467 |
| 2002/0046675 A1 | | 4/2002 | Young | |
| 2002/0102910 A1 | | 8/2002 | Donahue et al. | |
| 2003/0013377 A1 | | 1/2003 | Aldred et al. | |
| 2003/0013378 A1 | | 1/2003 | Aldred et al. | |
| 2003/0013525 A1 | | 1/2003 | Aldred et al. | |

* cited by examiner

*Primary Examiner*—Derris H. Banks
*Assistant Examiner*—Ali Abdelwahed
(74) *Attorney, Agent, or Firm*—Cooley Godward LLP

(57) ABSTRACT

A toy assembly that includes a remotely controlled vehicle is disclosed. In one embodiment, the toy assembly includes a remote control that can be used to control a toy vehicle. In one embodiment, the remote control includes a chip with pre-recorded content stored thereon. In one embodiment, the remote control can be coupled to an audio amplifier that can generate audible outputs. In another embodiment, the remote control can be used in a hand-held configuration.

20 Claims, 9 Drawing Sheets

TOY ASSEMBLY AND A METHOD OF USING THE SAME

BACKGROUND OF THE INVENTION

This invention relates generally to a toy assembly, and more particularly, to a toy assembly with a remotely controlled vehicle.

Many conventional toy assemblies include toy vehicles that can be manipulated to generate different play situations and scenarios. Some conventional toy vehicles are remotely controllable by a user. Such conventional toy vehicles are limited in scope and features. Accordingly, children become bored quickly while using conventional toy vehicles.

A need exists for a new toy assembly that has several features that provide various play scenarios for a child.

SUMMARY OF THE INVENTION

In one embodiment, the toy assembly includes a remotely controlled vehicle. In another embodiment, the toy assembly includes a remote control that can be used to control a toy vehicle.

In one embodiment, a remote control includes a chip with pre-recorded audible content. In one embodiment, the remote control can be coupled to an audio amplifier that can generate audible outputs. In another embodiment, the remote control can be used in a hand-held configuration.

DETAILED DESCRIPTION OF THE INVENTION

In one embodiment, the toy assembly includes a remotely controlled vehicle. In another embodiment, the toy assembly includes a remote control that can be used to control a toy vehicle.

In one embodiment, a remote control includes a chip with pre-recorded audible content. In one embodiment, the remote control can be coupled to an audio amplifier that can generate audible outputs. In another embodiment, the remote control can be used in a hand-held configuration.

Figure 1:
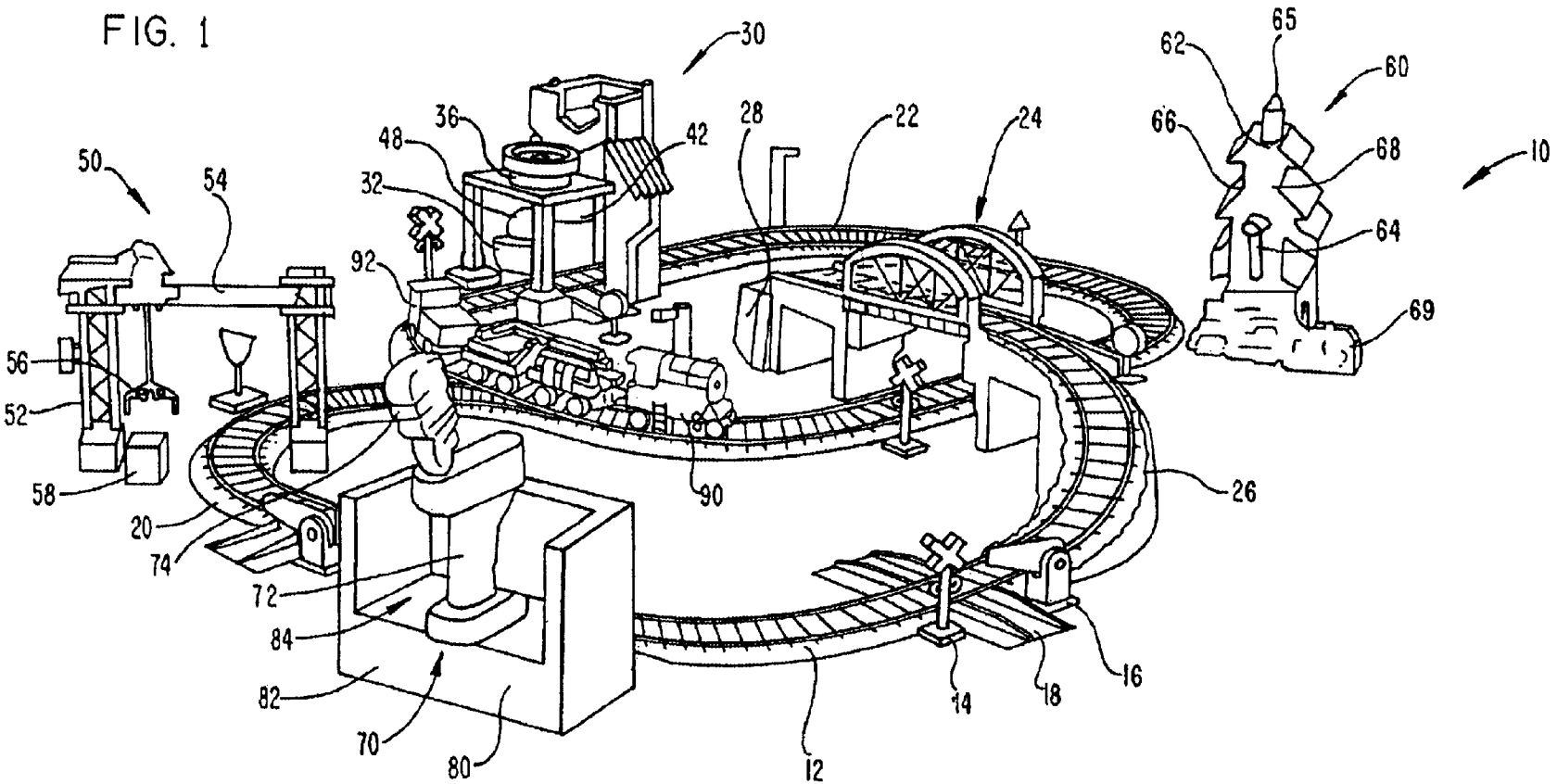
FIG. 1 is a perspective view of an embodiment of a toy assembly according to the invention.

A perspective schematic view of an embodiment of a toy assembly according to the invention is illustrated in FIG. 1. In this embodiment, the toy assembly 10 includes a track 12. The track 12 can include any number of individual track sections, i.e. sections 20 and 22, that can be coupled together in various combinations to form a continuous path on which a toy vehicle can travel. One type of track connection that can be used to couple track sections is disclosed in U.S. patent application Ser. No. 10/285,698, entitled "Toy Track and Method of Assembling and Disassembling the Same," filed Nov. 1, 2002, the disclosure of which is incorporated by reference herein.

The toy assembly 10 includes several objects related to the environment of the toy assembly 10. For example, the toy assembly 10 can include a warning light structure 14, a gate crossing 16, and a ramp 18. These and other objects can be any shape or configuration and can be formed of plastic. The track 12 includes a bridge 24 and bridge ramps 26 and 28 coupled to the bridge 24.

The toy assembly 10 can include any number of interactive work sites or structures that enhance the play options of the toy assembly 10. In various embodiments, any combination of sites and/or structures can be used. In the illustrated embodiment, the toy assembly 10 includes a coal mine work site 30. This work site 30 includes a bucket 32 that slides up and down to deliver a ball 48 to a hopper 36. The hopper 36 is configured to receive the ball 48 and deliver the ball 48 to a shaft 42. The shaft 42 is configured to receive the ball 48 and deliver it to a vehicle located below the shaft 42.

The toy assembly 10 includes a gantry work site 50. This work site 50 includes a frame 52 that supports a horizontal boom 54. A claw 56 is slidably coupled to and movable along the boom 54. The claw 56 can be manipulated to pick up a crate 58 or other object. This work site 50 can be located next to any straight piece or curved piece of track by engaging a finger (not shown) on the frame 52 with a groove (not shown) on the track 12.

The toy assembly 10 includes a pipe works work site 60. This work site 60 includes a pipe building 62 that delivers pipes to the front side 66 of the building 62 or to the back side 68 of the building 62. A knob 64 is coupled to the building 62. The knob 64 can be turned to deliver pipes to the front of the building 62 by turning the knob 64 counter-clockwise and to the rear of the building 62 by turning the knob 64 clockwise.

A vehicle can be placed in the front of the building 62 to receive pipes. In one embodiment, the work site 60 includes a rear ramp 69 on which a vehicle can be positioned to receive pipes from the building 62. In one embodiment, the building 62 includes a smoke stack 65 from which a puff of smoke is produced when the knob 64 is turned. This site 60 can be disposed at any location along the track.

The toy assembly 10 includes several vehicles that can be moved along the track 12. One vehicle 90 resembles a train and can be remotely controlled. The train 90 is a self-powered vehicle that can pull several other vehicles 92.

The toy assembly 10 includes a controller or remote control 70. The controller 70 can be used to control a vehicle of the toy assembly 10. In this embodiment, the controller 70 is used to control the train 90 via infrared signals transmitted from the controller 70 to the train 90.

In this embodiment, the controller 70 includes a body 72 and an actuator 74 that is movable relative to the body 72. Based on the movement of the actuator 74, the controller 70 sends the appropriate signals to the train 90 to control the motion thereof. In alternative embodiments, the controller 70 can have any shape or configuration.

The toy assembly 10 also includes an output unit or station 80 that has a base 82 and a docking area or port 84. As illustrated in FIG. 1, the controller 70 can be coupled or docked to the station 80. As discussed in detail below, the station 80 includes an output generating system that plays audible outputs when a controller is coupled to the port 84.

Figure 2:
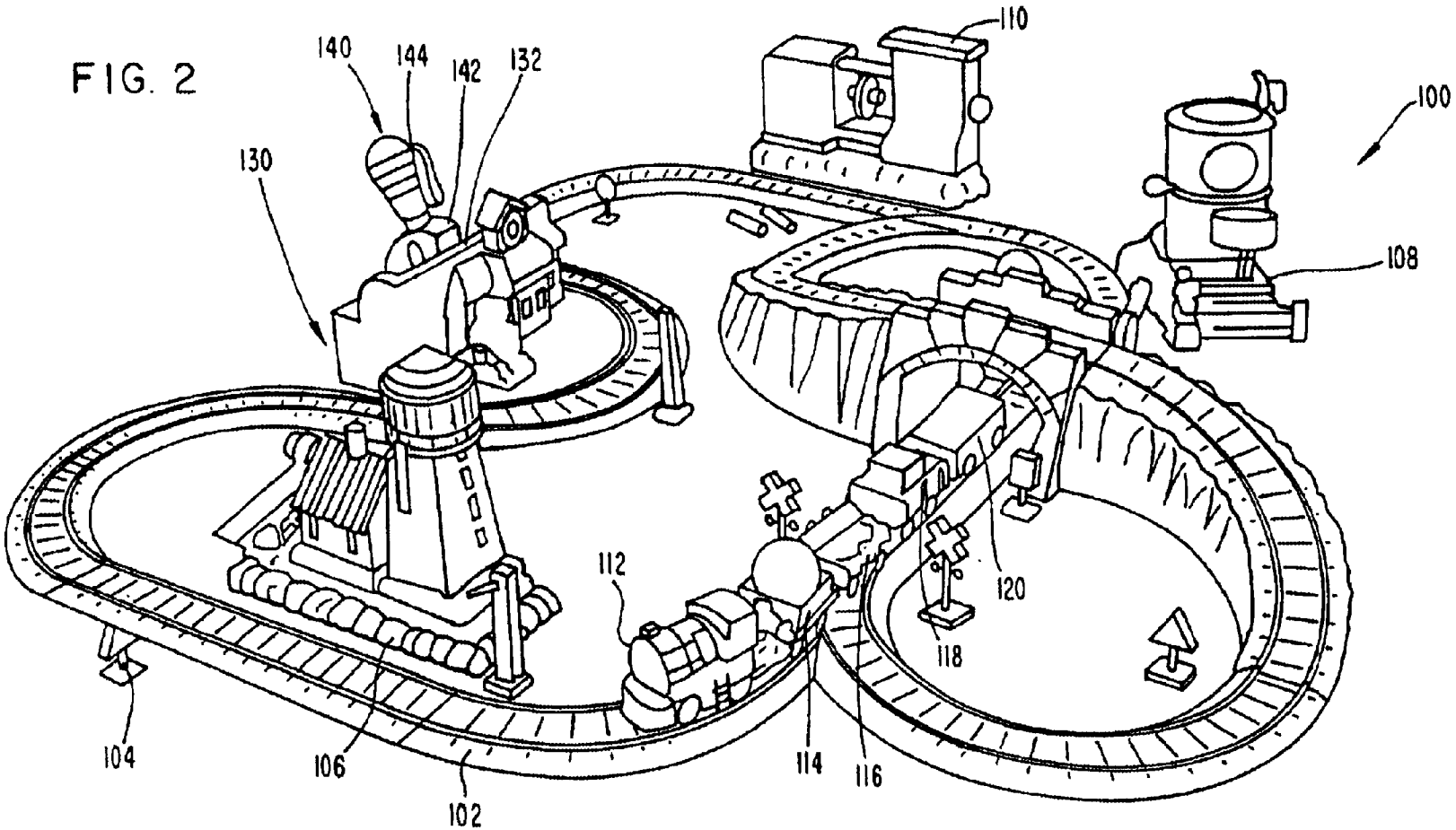
FIG. 2 is a perspective view of another embodiment of a toy assembly according to the invention.

Another embodiment of a toy assembly according to the invention is illustrated in FIG. 2. In this embodiment, the toy assembly 100 includes a track 102 and several articles 104 and work sites 106, 108, and 110 that can be located proximate to the track 102. Articles 104 and work sites 106, 108 and 110 are intended to be illustrative only. In alternative embodiments, any number and types of articles and work sites can be utilized with the track 102.

Toy assembly 100 includes several vehicles, including an engine 112 that can be remotely controlled. The other vehicles can include a coal car 114, a pipe car 116, a crate car 118, and a caboose 120.

In this embodiment, toy assembly 100 includes a station 130 and a controller 140. The station 130 includes a base 132 and a docking area (not shown). The controller 140 includes a housing 142 and an actuator 144 that can be manipulated to control the engine 112.

Figure 3:
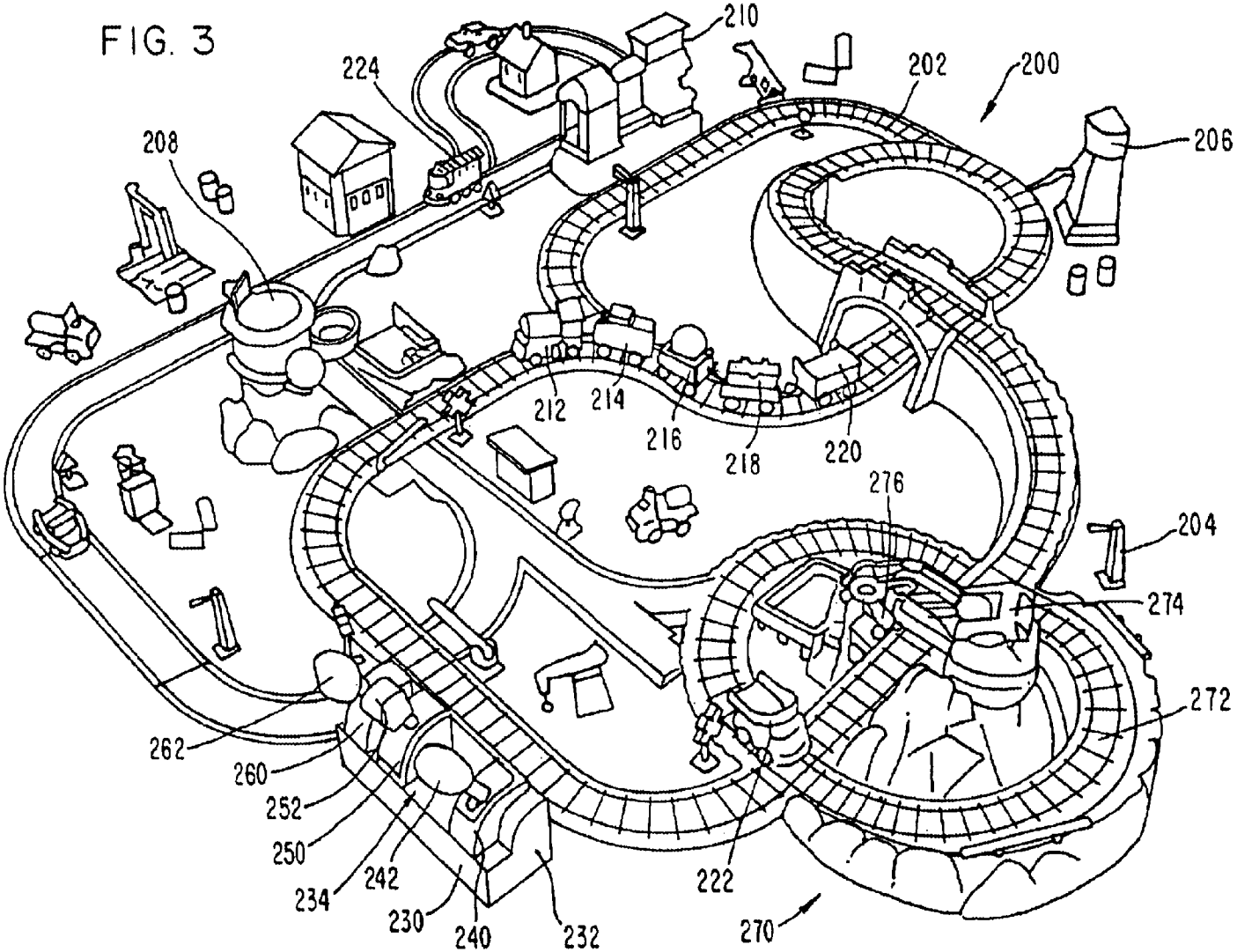
FIG. 3 is a perspective view of another embodiment of a toy assembly according to the invention.

Another embodiment of a toy assembly according to the invention is illustrated in FIG. 3. In this embodiment, the toy assembly 200 includes a track 202 and several articles 204 and work sites 206, 208, and 210 that can be located proximate to the track 202.

Toy assembly 200 includes several vehicles, including an engine 212 that can be remotely controlled. Some other vehicles can include a crate car 214, a coal car 216, a pipe car 218, and a caboose 220. Any number of vehicles can be provided.

In this embodiment, toy assembly 200 includes a station 230. The station 230 includes a base 232 and a docking area 234.

Toy assembly 200 includes several controllers, each of which is programmed to control a single remotely controllable vehicle. As illustrated in FIG. 3, controllers 240, 250 and 260 can be coupled to a docking area 234 of the station 230. In this embodiment, controller 240 is configured to control a construction vehicle 222, controller 250 is configured to control a fire engine 224, and controller 260 is configured to control the train engine 212. Each of the controllers 240, 250 and 260 includes a housing and an actuator 242, 252 and 262, respectively, that can be manipulated to control the particular vehicle.

Toy assembly 200 includes a construction site 270 that can be coupled to and form part of the track 202. The construction site 270 includes a track portion 272 and a crane 274 with a claw 276.

Figure 4:
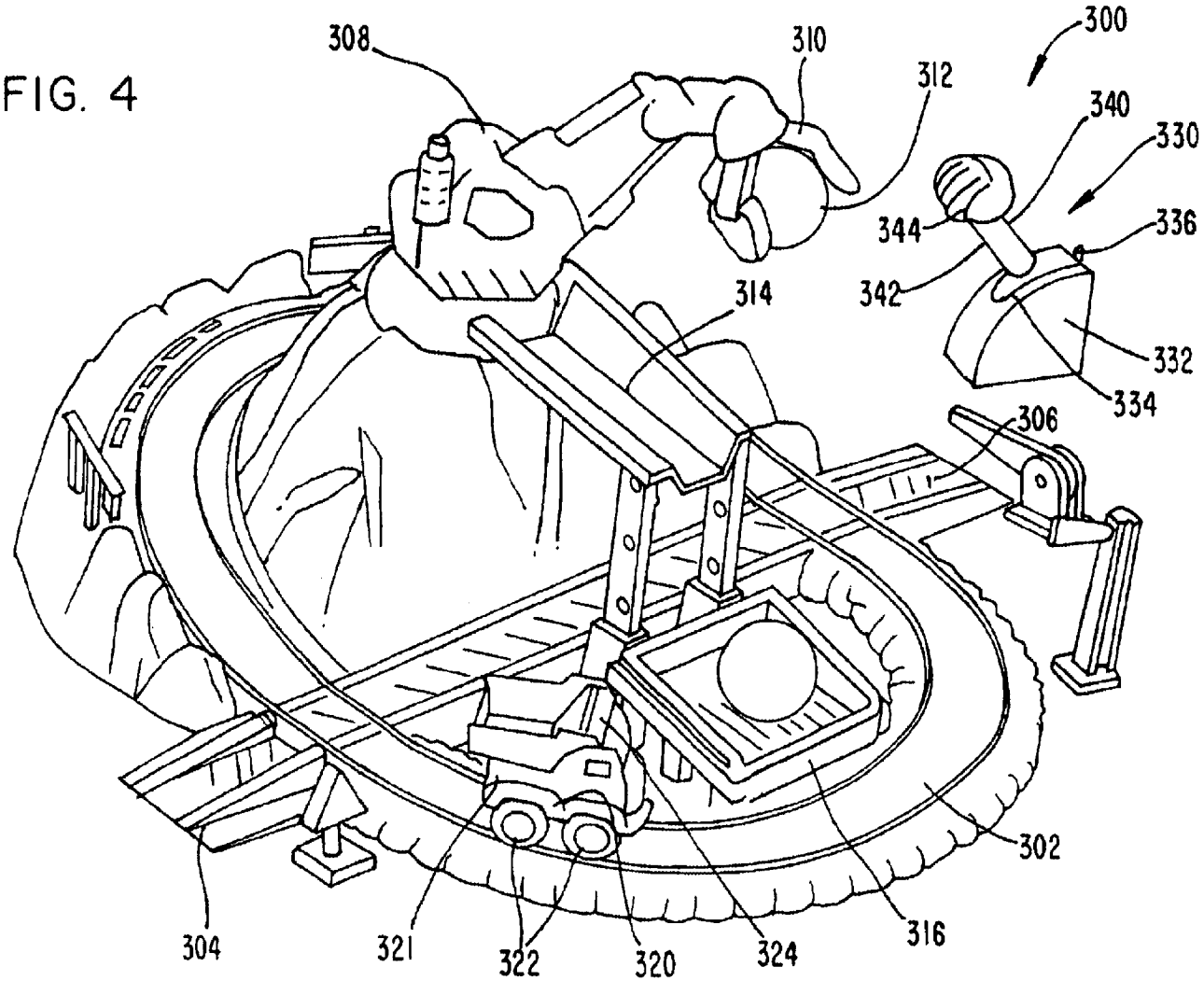
FIG. 4 is a perspective view of another embodiment of a toy assembly according to the invention.

Another embodiment of a toy assembly according to the invention is illustrated in FIG. 4. In this embodiment, the toy assembly 300 resembles a construction site. The toy assembly 300 includes a track 302 and ramps 304 and 306 coupled to the track 302. The toy assembly 300 also includes a crane 308 that has a claw 310 that is configured to grip a ball 312 or other object. The ball 312 can be dropped into a chute 314 that leads to a bucket 316.

Toy assembly 300 includes a toy vehicle 320. In this embodiment, the toy vehicle 320 includes a body 321 with wheels 322 coupled thereto. The vehicle 320 includes a receiver 324 that is coupled to the vehicle body 321. The receiver 324 is an infrared (IR) receiver that is configured to receive IR signals from a remote source. The vehicle 320 includes an LED (not shown) that is illuminated when the vehicle 320 receives instructions to move. After a conventional power down sequence, the LED is turned off to indicate that the vehicle 320 has powered down.

In this embodiment, toy assembly 300 includes a controller 330. The controller 330 is illustrated in a hand-held or stand along configuration. The controller 330 includes a housing 332 with a slot 334 formed therein. The housing 332 includes an IR transmitter 336 located on one of its surfaces. The IR transmitter 336 transmits IR signals to the vehicle 320. In alternative embodiments, the controller 330 can have more than one transmitter and each transmitter can be located at any location on the controller 330.

The controller 330 includes an actuator 340. The actuator 340 includes a shaft 342 with a grip portion 344 located at its upper end. The actuator 340 can be manipulated to close a switch in the housing 332 and send corresponding signals via the transmitter 336 to the vehicle 320.

Figure 5:
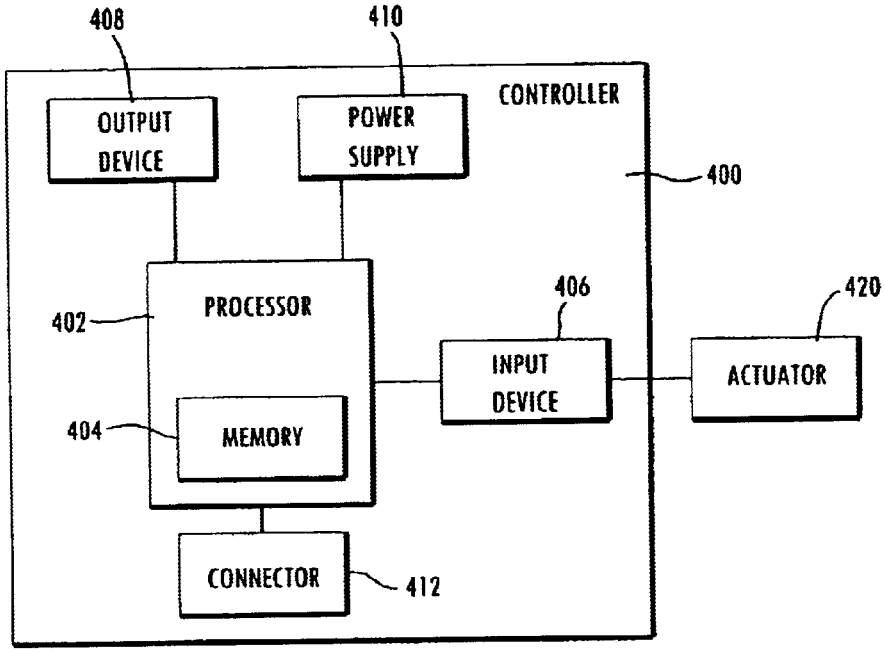
FIG. 5 is a schematic view of an embodiment of a controller according to the invention.
Figure 6:
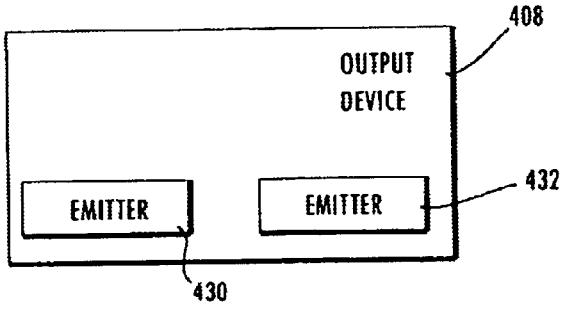
FIG. 6 is a schematic view of an embodiment of an output device according to the invention.
Figure 7:
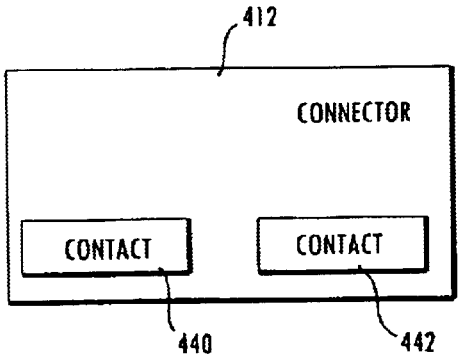
FIG. 7 is a schematic view of an embodiment of a connector according to the invention.

Schematic views of an embodiment of a controller according to the invention are illustrated in FIGS. 5–7. Controller 400 includes a control unit or processor 402 and an associated memory 404. The processor and memory can be any conventional processor and memory in which audible outputs and programmed logic can be stored. Some of the audible outputs can include sound effects associated with particular vehicles.

The controller 400 includes an output device 408 that is connected to the processor 402. The output device 408 can be any type of device that generates an output. In the illustrated embodiment, the output device 408 is an IR transmitter that transmits IR signals to a vehicle. In other embodiments, the output device can be a transmitter that transmits any type of signals, including radio frequency, electromagnetic, etc.

The controller 400 includes a power supply 410 that is connected to the processor 402. In this embodiment, the power supply 410 is several batteries. In other embodiments, any other type of power supply can be used.

The controller 400 also includes an input device 406. The input device 406 can be any device that receives an external signal or that can be manipulated to generate a signal that can be sent to the processor. In the illustrated embodiment, the input device 406 is a switch, and in particular, the input device 406 is a three position switch.

The controller 400 also includes an actuator 420. The actuator 420 is coupled to the controller 400 for movement relative thereto. Actuator 420 is configured to engage the input device 406 so that an appropriate signal is generated and sent to the processor 402. In the illustrated embodiment, the actuator 420 can be moved to place the switch in any one of its three positions.

The controller 400 also includes a connector 412 that is connected to the processor 402. The connector 412 can be used to couple the controller 400 to another device that includes an output generating mechanism. For example, the connector 412 can be coupled to a corresponding connector on a device that includes a speaker through which audible outputs stored in memory 204 can be played, as discussed in detail below.

A schematic view of an embodiment of an output device according to the invention is illustrated in FIG. 6. The output device 408 includes two emitters or transmitters 430 and 432, each of which is configured to transmit a signal. The transmitters 430 and 432 are configured to transmit an IR signal. In alternative embodiments, the output device can include any number of emitters or transmitters.

A schematic view of an embodiment of a connector according to the invention is illustrated in FIG. 7. The connector 412 includes two metallic or conductive contacts 440 and 442. In an alternative embodiment, the connector can include any number of contacts. The function of the contacts is described below.

Figure 8:
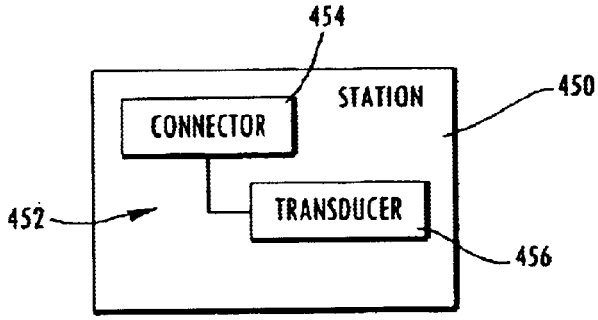
FIG. 8 is a schematic view of an embodiment of a station according to the invention.

A schematic view of an embodiment of a station according to the invention is illustrated in FIG. 8. The station 450 includes an output generating mechanism 452. The output generating mechanism 452 includes conventional electrical components that are used to generate an audible output. In one embodiment, the output generating mechanism 452 includes a connector 454 and a transducer or speaker 456. The connector 454 is configured to engage and be operatively coupled to the connector 412 on the controller 400. When the connectors 412 and 454 contact each other, power is supplied from the controller 400 to the speaker 456 and the processor 402 selects an audible output, such as a sound effect for a particular vehicle, from the memory 404. The selected audible output is then generated by the speaker 456.

Figure 9:
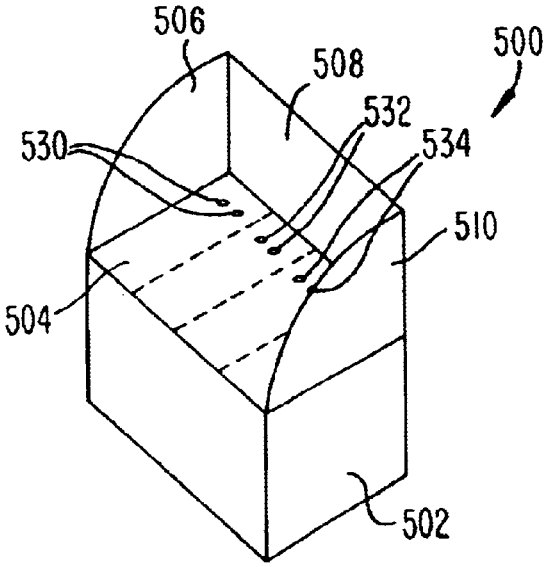
FIG. 9 is a perspective view of an embodiment of a station according to the invention.
Figure 10:
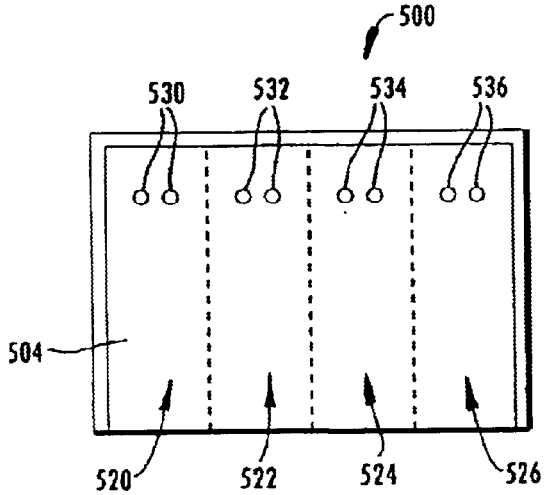
FIG. 10 is a top view of the station of FIG. 9.

An embodiment of a station according to the invention is illustrated in FIGS. 9 and 10. In this embodiment, the station 500 includes a base 502 that has an upper surface 504. Several walls 506, 508 and 510 are disposed along the perimeter of the upper surface 504 to form an enclosure.

The station 500 includes several coupling or docking areas or ports 520, 522, 524 and 526 that are each configured to receive a controller therein. The docking areas 520, 522, 524 and 526 can be separated by a wall or other structure or alternatively, can be part of an open area as illustrated in FIG. 10.

The station 500 includes several connectors or contacts associated with each of the ports. As illustrated, contacts 530 are associated with port 520, contacts 532 are associated with port 522, contacts 534 are associated with port 524, and contacts 536 are associated with port 526. In alternative embodiments, any number and type of contact can be used in each of the ports. Similarly, the contacts can be located on one of the walls of the station instead of or in addition to the upper surface of the base.

Figure 12:
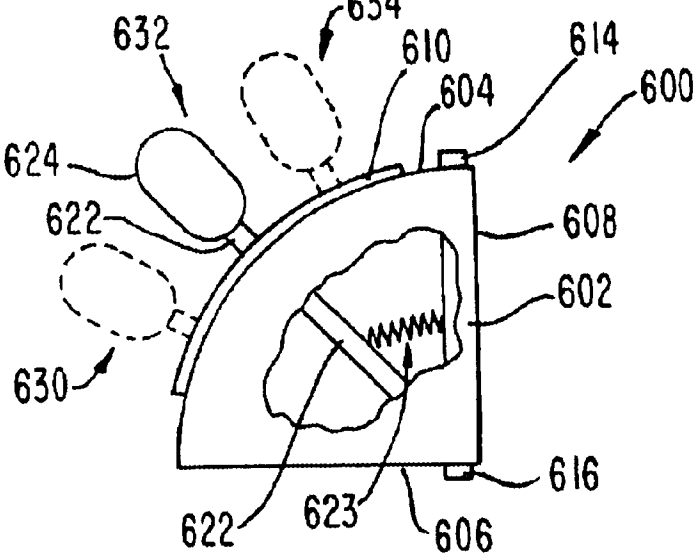
FIG. 12 is a side view of the controller of FIG. 11.
Figure 11:
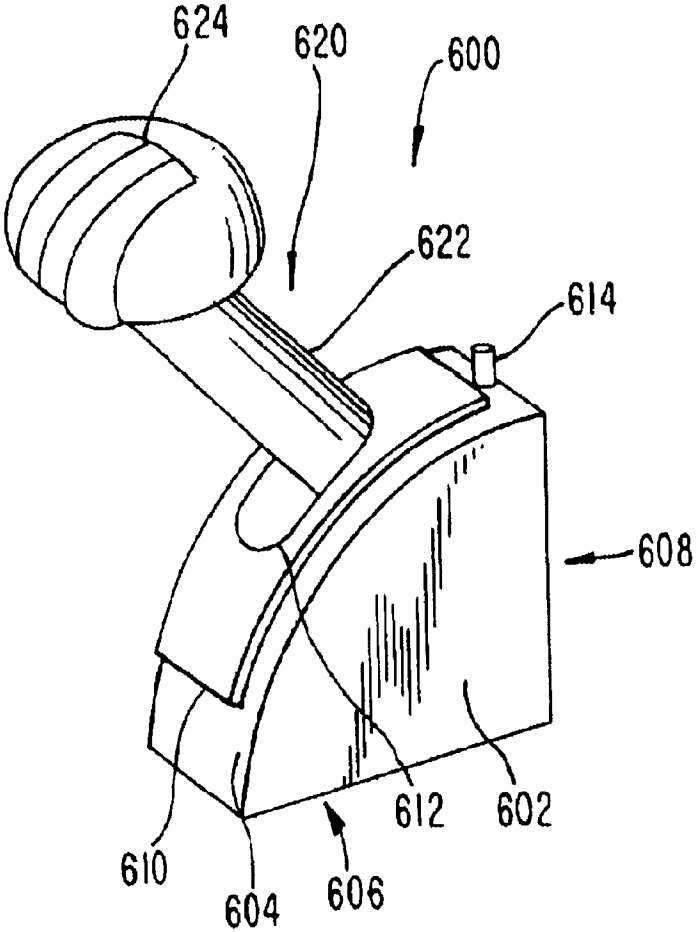
FIG. 11 is a perspective view of an embodiment of a controller according to the invention.
Figure 13:
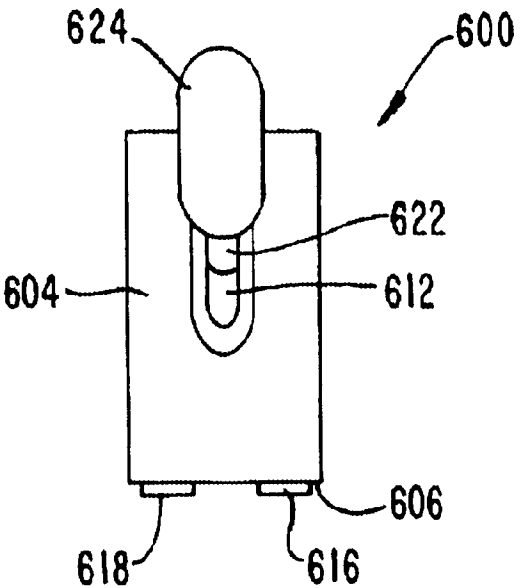
FIG. 13 is an end view of the controller of FIG. 11.

An embodiment of a controller according to the invention is illustrated in FIGS. 11–13. In this embodiment, the controller 600 includes a housing 602 with an upper surface 604, a lower surface 606, and a front surface 608. In some embodiments, a plate 610 can be coupled to the upper surface 604. The upper surface 604 and the plate 610 have a slot 612 formed therein.

The controller 600 includes an output device or transmitter 614 coupled to the housing 602. In this embodiment, the transmitter 614 is configured to transmit IR signals to a vehicle. In an alternative embodiment, the controller 600 can have multiple transmitters spaced apart from each other.

In one embodiment, the controller 600 includes several contacts 616 and 618 on its lower surface 606. The contacts 616 and 618 are metallic or conductive pieces of material that are coupled to the housing 602. The contacts 616 and 618 are configured to engage any set of contacts on the station 500. In alternative embodiments, the contacts can have any shape or configuration and the controller can include any number of contacts.

The controller 600 includes an actuator 620 that is movably coupled to the housing 602. The actuator 620 includes a shaft 622 and a handle or grip 624. As the actuator 620 is moved, the shaft 622 can travel along the slot 612 on the housing 602.

As illustrated in FIG. 12, the actuator 620 can be positioned in several different positions relative to the housing 602. The actuator 620 can be disposed in a first position 630, a second position 632, and a third position 634. In one embodiment, the first position 630 corresponds to an off position, the second position 632 corresponds to a forward movement position, and the third position 634 corresponds to a forward movement and audible output position. In one embodiment, the positions 630, 632 and 634 of the actuator 620 can be approximately 45°, 70° and 95°, respectively, from a horizontal plane that extends toward the front of the controller 620.

When the actuator 620 is in its first position 630, the controller 600 does not send a signal to the vehicle. When the actuator 620 is in its second position 632 or in its third position 634, the controller 600 sends an intermittent IR signal to the vehicle instructing the vehicle to move forward. The signal is sent via an IR transmission in the form of packets of binary code. When the actuator 620 is in its third position 634 and the controller 600 is coupled to the station 500, an audible output is generated from the station. Thus, audible outputs are generated by the station 500 only when a controller is coupled to the station 500.

In the illustrated embodiment, the controller 600 includes a biasing element 623, such as a spring, that biases the actuator 620 from its third position 634 to its second position 632. Thus, when released, it naturally moves back to the second position. In other embodiments, the biasing element can be any structure that can bias the actuator 620 in a particular direction.

Figure 14:
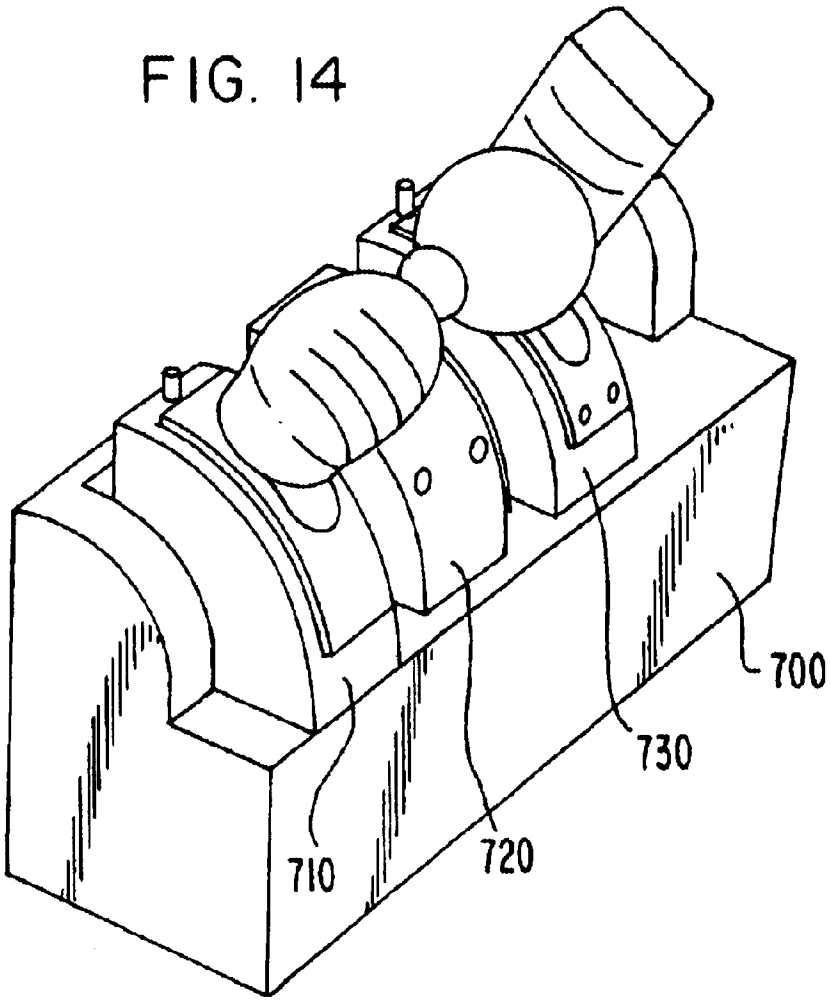
FIG. 14 is a perspective view of a station and several controllers according to the invention.

Referring to FIG. 14, several controllers are coupled to a station. Controllers 710, 720 and 730 are coupled to the station 700 in a manner similar to that previously described. Controllers 710, 720 and 730 are each configured to send control signals to a particular vehicle or object in a toy assembly. In one embodiment, each controller 710, 720 and 730 is configured to transmit packets of binary code at different pulse rates. The pulse rates are based on a rate of commands per second. Each vehicle is likewise configured to receive a signal that is being transmitted at a particular pulse rate, and therefore, receive a signal from only one of the controllers.

Each of the controllers 710, 720 and 730 includes an actuator that can be moved to different positions. When the actuator of any one of the controllers 710, 720 and 730 is moved to its third position, as previously described, a corresponding audible output stored in the memory of the particular controller is output via the speaker in the station 700 and a forward motion signal is transmitted to the corresponding vehicle. The speaker in the station reduces the need to provide a speaker in each of the controllers in order to generate an audible output associated with a particular controller and vehicle.

Figure 15:
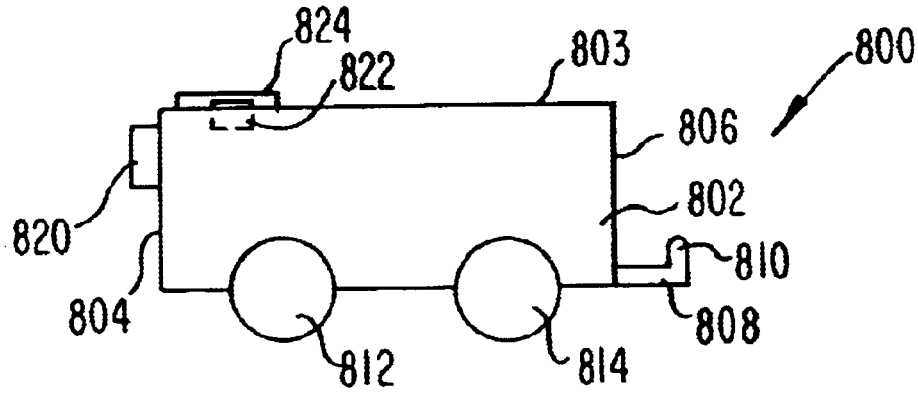
FIG. 15 is a schematic side view of an embodiment of a vehicle according to the invention.

An embodiment of a vehicle according to the invention is illustrated in FIG. 15. In this embodiment, the vehicle 800 includes a body 802 with a top surface 803, a front end 804, and a rear end 806. The vehicle 800 includes a connector 808 coupled to the rear end 806 of the body 802. The connector 808 has an upwardly extending hook member 810 that can be engaged with a corresponding recess of another vehicle.

The vehicle 800 includes several wheels 812 and 814 are coupled to the body 802. The wheels 812 and 814 can be driven by an internal drive mechanism (not shown). An exemplary drive mechanism that can be used is disclosed in co-pending U.S. patent application Ser. No. _____, entitled "Drive Mechanism for a Toy Vehicle and a Method of Using the Same," filed Nov. 1, 2002 (Attorney Docket No. FSHR-063/00US), the disclosure of which is incorporated by reference herein.

In this embodiment, the vehicle 800 includes an LED 820 located proximate to its front end 804 and a receiver 822 disposed proximate to its upper surface 803. The LED 820 indicates when the processor on the vehicle 800 has entered a power down mode. The vehicle 800 includes a reset switch (not shown) that can be pressed to activate the processor on the vehicle from its power down mode.

The receiver 822 can be enclosed by a cover 824. In one embodiment, the receiver 822 is an IR receiver that is configured to receive IR signals from an external source.

In one embodiment, the wheels of the vehicle 800 include molded in friction strips that engage a support surface as the vehicle 800 moves. In another embodiment, the wheels of the vehicle 800 include ridges formed therein that enhance traction of the wheels along a support surface.

Figure 16:
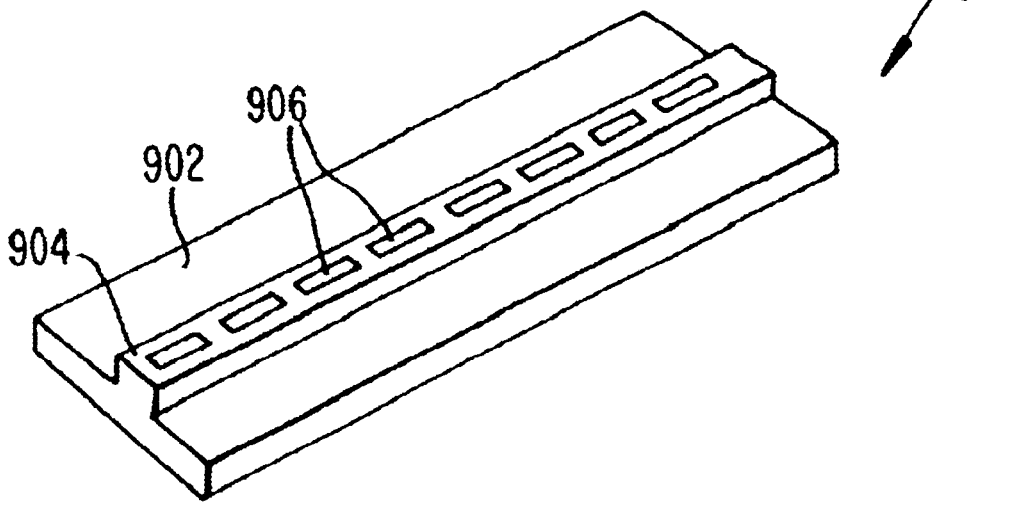
FIG. 16 is a perspective view of a track section according to the present invention.

An embodiment of a track section according to the invention is illustrated in FIG. 16. In this embodiment, the track section 900 includes a body portion 902 that has a ridge 904 that extends along the track section 900. In alternative embodiments, the openings or recesses in the rail 904 can have any particular shape, configuration and frequency along the rail.

While the invention has been described in detail and with reference to specific embodiments thereof, it will be apparent to one skilled in the art that various changes and modifications may be made therein without departing from the spirit and scope thereof. Thus, it is intended that the present invention covers the modifications and variations of this invention provided they come within the scope of the appended claims and their equivalents.

What is claimed is:

1. A toy comprising:

a housing, said housing including a body defining a coupling area and an output generating device;

a toy vehicle; and a controller, said controller including a control unit having audible outputs stored therein, said controller being configured to provide instructions to said toy vehicle to move said toy vehicle and to be coupled to said housing at said coupling area, said controller being operable in a first configuration separate from said housing and in a second configuration coupled to said housing, said housing being configured to generate an audible output when said controller is coupled to said housing.

2. The toy of claim 1, said toy vehicle being a first toy vehicle and said controller being a first controller, said toy further comprising:

a second toy vehicle; and a second controller, said second controller being configured to provide instructions to said second toy vehicle to move said second toy vehicle, said coupling area of said housing including a first port configured to receive said first controller and a second port configured to receive said second controller.

3. The toy of claim 2, said first controller including an outer surface and a contact disposed on said first controller outer surface, said second controller including an outer surface and a contact disposed on said second controller outer surface, said housing including a first contact and a second contact disposed thereon, said first contact being configured to be coupled to said first controller contact, and said second contact being configured to be coupled to said second controller contact.

4. The toy of claim 1, said controller including an outer surface and a pair of contacts disposed on said outer surface, said pair of contacts being connected to said control unit.

5. The toy of claim 1, said controller including an outer surface and a pair of contacts disposed on said outer surface, said pair of contacts on said controller being connected to said control unit, and said housing including a pair of contacts, said housing pair of contacts being connected to said output generating device.

6. The toy of claim 1, said controller including a body and an actuator coupled to said body, said actuator being selectively disposable in a plurality of positions with respect to said body.

7. The toy of claim 1, said controller including a body and an actuator coupled to said body, said actuator being selectively disposable in a plurality of positions with respect to said body, said plurality of positions including a first position corresponding to an off position, and a second position corresponding to a movement position, said controller providing instructions to said toy vehicle to move when said actuator is in said second position.

8. The toy of claim 7, said plurality of positions including a third position corresponding to a output generating position, said controller providing instructions to said toy vehicle to move and said housing generating an audible output when said actuator is in said third position.

9. A method of using a toy train set, the toy train set including a track, an output unit, a toy vehicle, and a remote control, the output unit including an output generating system, the method comprising:

coupling the remote control to the output unit; and moving an actuator on the remote control from a first position to a second position to move the toy vehicle along the track;

moving the actuator from the second position to a third position; and generating an audible output via the output unit, said generating an audible output occurring substantially simultaneously with said moving the actuator from the second position to a third position.

10. The method of claim 9, the remote control including a processor having a memory with a plurality of audible outputs stored therein, and said generating an audible output includes accessing at least one of said plurality of audible outputs.

11. The method of claim 9, said moving the actuator from the second position to a third position includes moving the actuator against a resilient member that biases the actuator from the third position to the second position.

12. The method of claim 9, the output unit including a speaker and a pair of contacts disposed on the output unit, the remote control including a processor having a memory with a plurality of audible outputs stored therein and a pair of contacts disposed on the remote control, said coupling the remote control to the output unit including disposing the remote control proximate to the output unit so that the contacts on the remote control engage the contacts on the output unit and the output generating system can access at least one of the audible outputs.

13. The method of claim 12, the remote control including a power supply, and said coupling the remote control to the output unit including providing power from the power supply to the output unit.

14. A method of controlling a plurality of toy vehicles using a control system, the control system including a first remote control, a second remote control, and a station, the method comprising:

coupling the first remote control to the station;

coupling the second remote control to the station;

moving an actuator on the first remote control from a first position to a second position to move a first toy vehicle;

moving an actuator on the second remote control from a first position to a second position to move a second toy vehicle;

moving the actuator on the first remote control from its second position to a third position; and generating a first audible output via the station, said generating an audible output occurring substantially simultaneously with said moving the actuator on the first remote control from its second position to a third position.

15. The method of claim 14, further comprising:

moving the actuator on the second remote control from its second position to a third position, said moving the actuator on the second remote control from its second position to a third position occurring independently of said moving the actuator on the first remote control from its second position to its third position; and generating a second audible output via the station, said generating a second audible output occurring substantially simultaneously with said moving the actuator on the second remote control from its second position to a third position.

16. A toy assembly comprising:

a track;

a first toy vehicle;

a second toy vehicle;

a first controller, said first controller being configured to control said first toy vehicle, said first controller including an audible output stored therein;

a second controller, said second controller being configured to control said second toy vehicle;

an output unit, said output unit being configured to receive said first controller and said second controller, said first controller being operable in a hand-held configuration and in a docked configuration in which said first controller is coupled to said output unit, said output unit being configured to generate said audible output when said first controller is in said docked configuration.

17. The toy assembly of claim 16, said second controller including an audible output stored therein, said second controller being operable in a hand-held configuration and in a docked configuration in which said second controller is coupled to said output unit, said output unit being configured to generate said audible output of said second controller when said second controller is in its docked configuration.

18. The toy assembly of claim 16, said first controller having a housing and an actuator that is movable relative to said housing, said actuator being disposable in a first position, a second position, and a third position.

19. The toy assembly of claim 18, said first position being an off position, said second position being an on position for said first vehicle, and said third position being an on position with an audible output.

20. The toy assembly of claim 19, said output unit generating an audible output associated with said first toy vehicle when said first controller is coupled to said output unit and said first controller actuator is moved to said third position.

* * * * *